US010813453B2

(12) United States Patent
Knutson et al.

(10) Patent No.: US 10,813,453 B2
(45) Date of Patent: Oct. 27, 2020

(54) CORNER SHELF

(71) Applicant: SPG INTERNATIONAL LLC, Covington, GA (US)

(72) Inventors: James Knutson, McDonough, GA (US); Arturo Gonzalez, Lilburn, GA (US)

(73) Assignee: SPG INTERNATIONAL LLC, Covington, GA (US)

( * ) Notice: Subject to any disclaimer, the term of this patent is extended or adjusted under 35 U.S.C. 154(b) by 0 days.

(21) Appl. No.: 16/462,502

(22) PCT Filed: Nov. 30, 2017

(86) PCT No.: PCT/US2017/063941
§ 371 (c)(1),
(2) Date: May 20, 2019

(87) PCT Pub. No.: WO2018/102543
PCT Pub. Date: Jun. 7, 2018

(65) Prior Publication Data

US 2020/0069051 A1 Mar. 5, 2020

Related U.S. Application Data

(60) Provisional application No. 62/429,008, filed on Dec. 1, 2016.

(51) Int. Cl.
*A47B 81/00* (2006.01)
*A47B 96/02* (2006.01)

(52) U.S. Cl.
CPC ..... *A47B 81/002* (2013.01); *A47B 96/027* (2013.01)

(58) Field of Classification Search
CPC ..... A47B 96/02; A47B 96/027; A47B 81/002
(Continued)

(56) References Cited

U.S. PATENT DOCUMENTS 2,993,603 A * 7/1961 Fohn ..... A47B 96/028 108/152
4,762,072 A * 8/1988 Boundy ..... A47B 21/06 108/50.02

(Continued)

FOREIGN PATENT DOCUMENTS

DE 202009015248 U1 3/2011
EP 1072216 A1 1/2001

OTHER PUBLICATIONS

International Search Report and Written Opinion for Application No. PCT/US2017/063941 dated Feb. 13, 2018 (10 pages).

*Primary Examiner* — Jose V Chen
(74) *Attorney, Agent, or Firm* — Michael Best & Friedrich LLP

(57) ABSTRACT

A shelf assembly includes a first shelf unit having a first shelf coupleable to a first vertical support post and a second vertical support post to present a first support surface. A second shelf unit includes a second shelf coupleable to a third vertical support post and a fourth vertical support post to present a second support surface. A third shelf unit includes a third shelf coupleable to a fifth vertical support post and a sixth vertical support post to present a third support surface. A first bridge includes a first support surface and a second bridge includes a second support surface. The first bridge and the second bridge are configured such that in an assembled state of the shelving system a support surface spans an arc of 90 degrees between the first shelf and the second shelf.

20 Claims, 6 Drawing Sheets

(58) Field of Classification Search
USPC ..... 108/42, 180, 108, 152
See application file for complete search history.

(56) References Cited

U.S. PATENT DOCUMENTS

| | | | | | |
|---|---|---|---|---|---|
| 4,763,579 | A * | 8/1988 | Cibulak | A47B 57/26 | 108/152 |
| 4,936,228 | A * | 6/1990 | Capo-Bianco | A47B 17/00 | 108/64 |
| 4,969,403 | A * | 11/1990 | Schwartz | A47B 5/00 | 108/147 |
| 5,083,512 | A * | 1/1992 | Newhouse | A47B 21/06 | 108/50.02 |
| D330,124 | S * | 10/1992 | Short | D6/648.3 | |
| 5,373,793 | A * | 12/1994 | Crossman | A47B 9/04 | 108/42 |
| D364,055 | S * | 11/1995 | Pakla | D6/675.1 | |
| 5,522,324 | A * | 6/1996 | van Gelder | A47B 21/06 | 108/50.02 |
| 5,595,427 | A | 1/1997 | Peters et al. | | |
| 5,628,255 | A * | 5/1997 | Neuner | A47B 21/00 | 108/42 |
| D391,415 | S * | 3/1998 | O'Sullivan | D6/648.3 | |
| 6,079,336 | A * | 6/2000 | Lindstrom | A47B 96/022 | 108/42 |
| 6,685,287 | B1 * | 2/2004 | Teel | A47B 13/10 | 312/238 |
| 8,333,158 | B2 * | 12/2012 | Wise | A47B 46/005 | 108/134 |
| 2003/0168951 | A1 * | 9/2003 | Holbrook | A47B 57/565 | 312/245 |
| 2005/0102911 | A1 | 5/2005 | Haberman | | |
| 2005/0150436 | A1 * | 7/2005 | Marchetta | A47B 96/027 | 108/108 |
| 2006/0213403 | A1 | 9/2006 | Witt | | |
| 2009/0001037 | A1 * | 1/2009 | Wilcock | A47B 97/00 | 211/119.003 |
| 2012/0037583 | A1 | 2/2012 | Wise | | |
| 2014/0263125 | A1 | 9/2014 | Gonzalez et al. | | |
| 2014/0353271 | A1 | 12/2014 | Kruse et al. | | |
| 2016/0143439 | A1 | 5/2016 | Jablow | | |
| 2016/0192777 | A1 | 7/2016 | Karins, Sr. | | |

* cited by examiner

CORNER SHELF

BACKGROUND

The present disclosure relates to a corner shelf design, and more particularly to a corner shelf that provides a smooth transition across a shelving unit.

Current corner shelf designs provide a 90-degree turn between adjacent perpendicularly oriented shelves of a shelving unit, which creates a sharp inside corner and consequently a generally poorer presentation of and access to items supported by the shelves.

SUMMARY

In one aspect, a shelf assembly includes a first shelf unit having a first shelf, a first vertical support post, a second vertical support post, a first bracket configured to couple the first shelf to the first vertical support post, and a second bracket configured to couple the first shelf to the second vertical support post. The first shelf is configured such that in an assembled state of the shelving system the first shelf extends between the first vertical support post and the second vertical support post and presents a first support surface configured to support a number of objects. A second shelf unit includes a second shelf, a third vertical support post, a fourth vertical support post, a third bracket configured to couple the second shelf to the third vertical support post, and a fourth bracket configured to couple the second shelf to the fourth vertical support post. The second shelf is configured such that in an assembled state of the shelving system the second shelf extends between the third vertical support post and the fourth vertical support post and presents a second support surface configured to support a number of objects. A third shelf unit includes a third shelf, a fifth vertical support post, a sixth vertical support post, a fifth bracket configured to couple the third shelf to the fifth vertical support post, and a sixth bracket configured to couple the third shelf to the sixth vertical support post, wherein the third shelf is configured such that in an assembled state of the shelving system the third shelf extends between the fifth vertical support post and the sixth vertical support post and presents a third support surface configured to support a number of objects. A first bridge has a support surface and is configured such that in an assembled state of the shelving system the first bridge provides a support surface between the first shelf and the third shelf. The first bridge is removably coupleable to the first shelf unit and the third shelf unit. A second bridge has a support surface and is configured such that in an assembled state of the shelving system the second bridge provides a support surface between the second shelf and the third shelf. The second bridge is removably coupleable to the second shelf unit and the third shelf unit. The first bridge and the second bridge are configured such that in an assembled state of the shelving system, the first shelf unit is oriented 90 degrees relative to the second shelf unit.

In another aspect, a shelf assembly includes a first shelf unit having a first shelf coupleable to a first vertical support post and a second vertical support post to present a first support surface. A second shelf unit includes a second shelf coupleable to a third vertical support post and a fourth vertical support post to present a second support surface. A third shelf unit includes a third shelf coupleable to a fifth vertical support post and a sixth vertical support post to present a third support surface. A first bridge includes a first support surface and a second bridge includes a second support surface. The first bridge and the second bridge are configured such that in an assembled state of the shelving system a support surface spans an arc of 90 degrees between the first shelf and the second shelf.

In yet another aspect, a shelf assembly includes a first shelf unit having a first shelf, a first vertical support post, a second vertical support post, a first bracket configured to couple the first shelf to the first vertical support post, and a second bracket configured to couple the first shelf to the second vertical support post. The first shelf is configured such that in an assembled state of the shelving system the first shelf extends between the first vertical support post and the second vertical support post and presents a first support surface configured to hold and support a number of objects. A second shelf unit includes a second shelf, a third vertical support post, a fourth vertical support post, a third bracket configured to couple the second shelf to the third vertical support post, and a fourth bracket configured to couple the second shelf to the fourth vertical support post. The second shelf is configured such that in an assembled state of the shelving system the second shelf extends between the third vertical support post and the fourth vertical support post and presents a second support surface configured to support a number of objects. A third shelf unit includes a third shelf, a fifth vertical support post, a sixth vertical support post, a fifth bracket configured to couple the third shelf to the fifth vertical support post, and a sixth bracket configured to couple the third shelf to the sixth vertical support post. The third shelf is configured such that in an assembled state of the shelving system the third shelf extends between the fifth vertical support post and the sixth vertical support post and presents a third support surface configured to support a number of objects. A first bridge is configured to support a number of objects and is configured such that in an assembled state of the shelving system the first bridge provides a support surface between the first shelf and the third shelf. The perimeter of the first bridge is formed from four sides with first and second opposed sides parallel to one another and third and fourth opposed nonparallel sides extending between the first and second opposed sides. At least one overhang projects from each of the four sides and each of the at least one overhang that projects from the third and fourth nonparallel sides is configured such that in an assembled state of the shelving system each of the at least one overhang that projects from the third and fourth nonparallel sides is positioned adjacent to one of the second bracket and the fifth bracket to removably couple the first bridge to the first shelf unit and the third shelf unit. A second bridge is configured to support a number of objects and is configured such that in an assembled state of the shelving system the second bridge provides a support surface between the second shelf and the third shelf. The perimeter of the second bridge is formed from four sides with first and second opposed sides parallel to one another and third and fourth opposed nonparallel sides extending between the first and second opposed sides. At least one overhang projects from each of the four sides and each overhang that projects from the third and fourth nonparallel sides is configured such that in an assembled state of the shelving system each overhang that projects from the third and fourth nonparallel sides is positioned adjacent to one of the third bracket and the sixth bracket to removably couple the second bridge to the second shelf unit and the third shelf unit. The first bridge and the second bridge are configured such that in an assembled state of the shelving system, the first shelf unit is oriented 90 degrees relative to the second shelf unit.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways.

Figure 1:
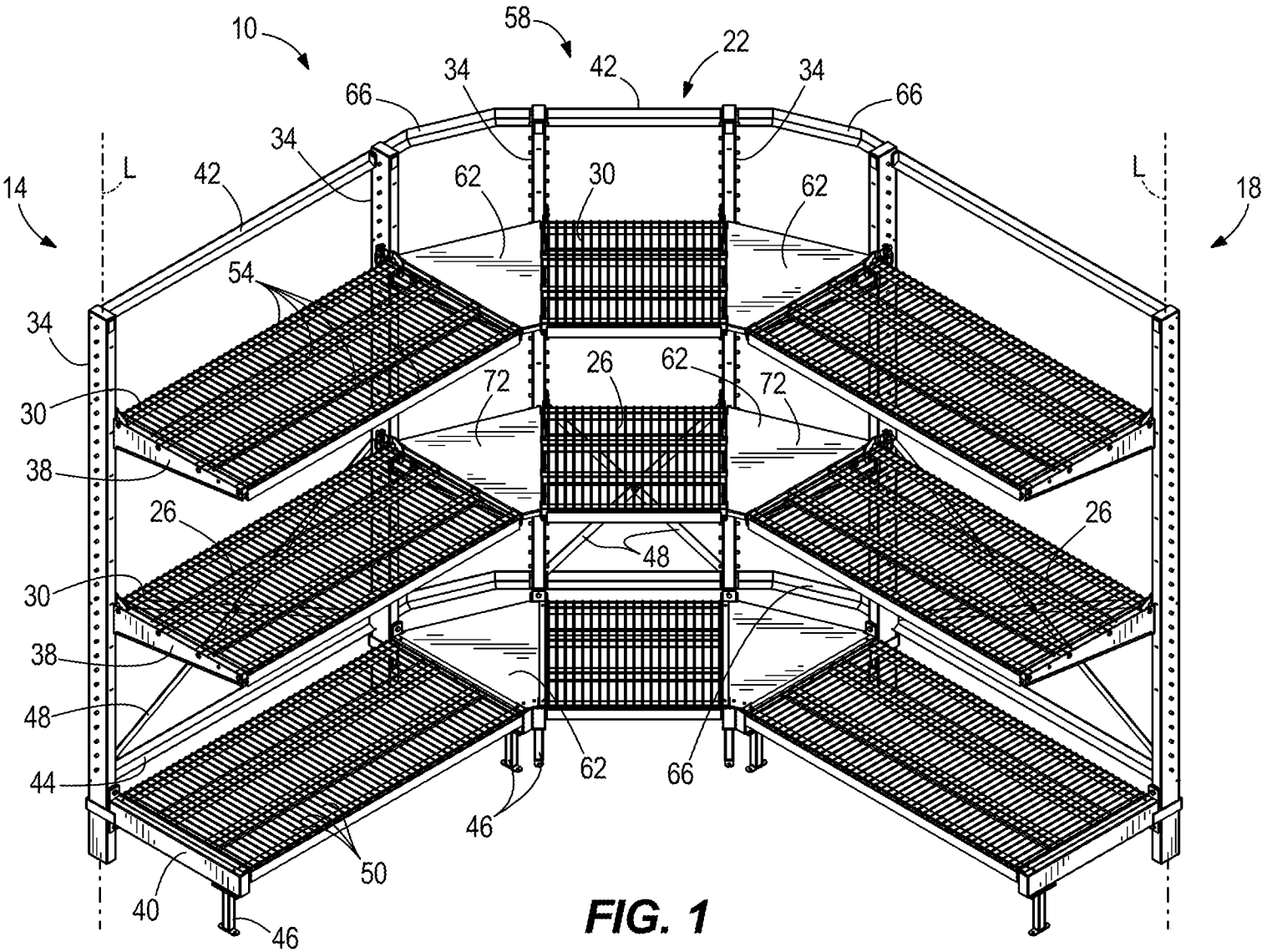
FIG. 1 is a perspective view of a shelving unit across a corner.
Figure 2:
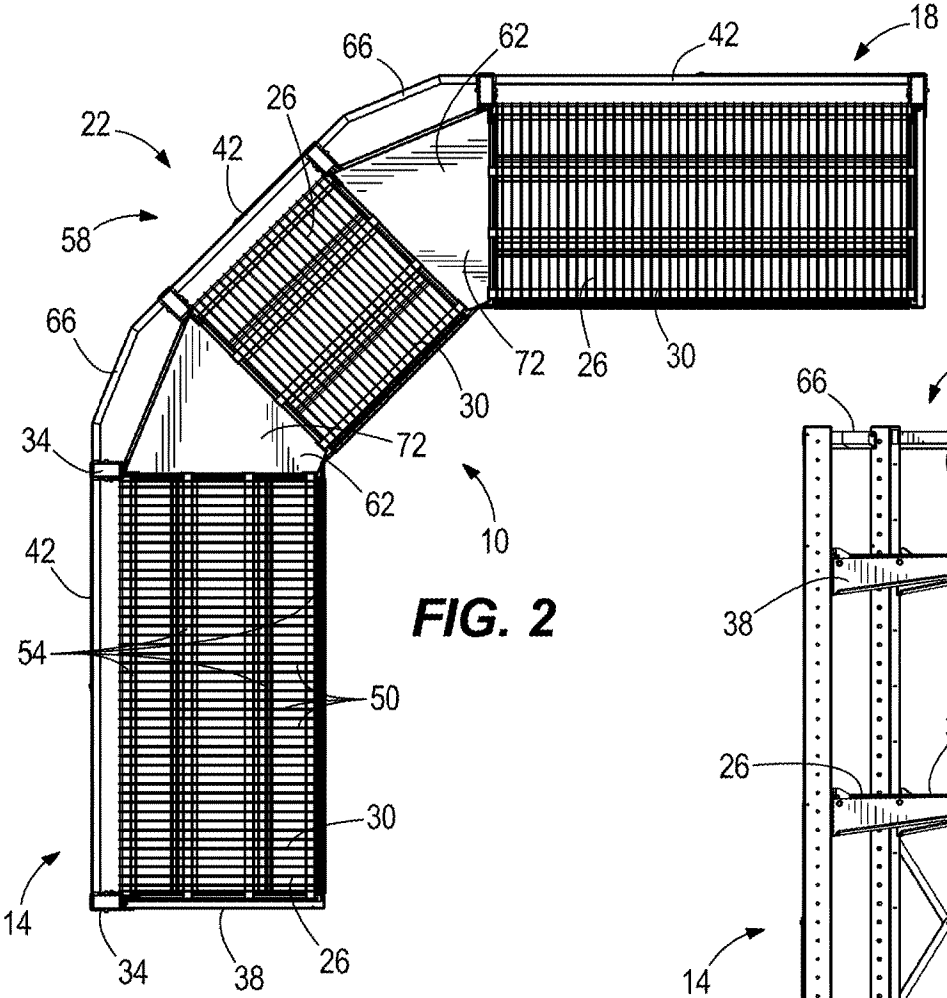
FIG. 2 is top view of the shelving unit of FIG. 1.

Referring to FIGS. 1 and 2, a shelving system 10 includes a left-hand shelving unit 14, a right-hand shelving unit 18, and a shelf corner unit 22. The shelf corner unit 22 provides a smooth transition across a corner and a continuous supporting surface between the left-hand and right-hand shelving units 14, 18.

The left-hand shelving unit 14 and the right-hand shelving unit 18 are substantially identical to one another. Each of the left-hand and the right-hand shelving units 14, 18 includes a plurality of shelves 30 spaced from one another along a vertical direction A (FIG. 3) parallel with the longitudinal axis L of a pair of support posts 34. Each shelf 30 includes a pair of brackets 38 and is coupled to the pair of vertical support posts 34 thereby. Brackets 38 may be formed integrally with the shelves 30 or as separate components to which the shelves 30 can be attached. In some embodiments, the shelf 30 nearest the ground or other foundation surface may include brackets 40 that are fixedly coupled to a respective one of the pair of support posts 34, as well as frontal support legs 46 for additional stability. The brackets 38, 40 may be cantilever brackets constructed of a metal, such as stainless steel. The vertical support posts 34 may be further coupled to one another by a top support bar 42 that extends between the ends of the pair of vertical support posts 34, a crossbar 44 that extends between the pair of vertical support posts 34 near the shelf 30 nearest the ground or other foundation surface, and crossbeams 48 that extend between the pair of vertical support posts 34 between the top support bar 42 and the crossbar 44, as shown in FIG. 1. In some embodiments, the vertical support posts 34 may be secured to a wall for added stability.

Each shelf 30 further includes a plurality of support members 54. The illustrated embodiment of FIGS. 1 and 2 in particular shows each shelf 30 including four support members 54 evenly spaced from one another and extending between two brackets 38 (or 40), with each support member 54 itself made of one or more metal tubes or angles integrally formed or otherwise attachable to the brackets 38 (or 40). In other embodiments, each shelf 30 may include more or fewer than four support members 54, the support members 54 may not be evenly spaced, and/or the support members 54 may be a single member as opposed to a plurality of tubes or angles.

Also illustrated are wire-frame shelf members or frame wires 50, which sit upon or may otherwise be secured to, the support members 54. In some embodiments, frame wires 50 provide at least part of a shelf support surface 26 configured to hold and support a number of objects, e.g., food products. Though illustrated as wire-frame shelf members in which the frame wires 50 sit upon or are secured to the support members 54, the shelves 30 are not so limited and may encompass various types of shelves and shelving. In some embodiments, for example, the frame wires 50 may be embodied as a wire cover grid that includes a first plurality of wires and a second plurality of wires. The second plurality of wires of the wire cover grid is arranged perpendicular to the first plurality of wires such that the first and second pluralities of wires are fixed to one another by known methods to make a wire-frame grid. Such a wire-frame grid may then simply be placed upon the brackets 38, 40 and/or the support members 54 to provide additional support for the number of objects. Alternatively, frame wires 50 may not be necessary in any form and support, i.e., the support surface 26, is provided through the support members 54 alone.

With continued reference to FIGS. 1 and 2, the shelf corner unit 22 connects the left-hand shelving unit 14 with the right hand shelving unit 18 and includes a connecting shelving unit 58, a plurality of corner shelving bridges 62, and a plurality of spreader bars 66. The connecting shelving unit 58 is sandwiched between two sets of the plurality of angle spreader bars 66 and the plurality of corner shelving bridges 62.

The connecting shelving unit 58 includes components that are similar to the components of the left-hand and right-hand shelving units 14, 18 described above. Accordingly, the same reference numerals will be used herein to describe the components of the connecting shelving unit 58, described below. The connecting shelving unit 58 includes a plurality of shelves 30 (with brackets 38, 40 and support members 54), a pair of vertical support posts 34, a top support bar 42, a crossbar 44, support legs 46, and crossbeams 48 as previously described. The frame wires 50, if present, of the shelves 30 of the connecting shelf unit 58 have substantially the same length (front to back) as the frame wires 50 of the shelves 30 of the left-hand and the right-hand shelving units 14, 18. The support members 54 of the shelves 30 of the connecting shelving unit 58 are, in the illustrated embodiment, not as long as the support members 54 of the shelves 30 of the left-hand and right-hand shelving units 14, 18. As such, the connecting shelving unit 58 is not as wide as the left-hand and the right-hand shelving units 14, 18 in the embodiment illustrated in FIG. 1. In other embodiments, the connecting shelving unit 58 may be constructed to have any suitable width for the environment of use.

Figure 5:
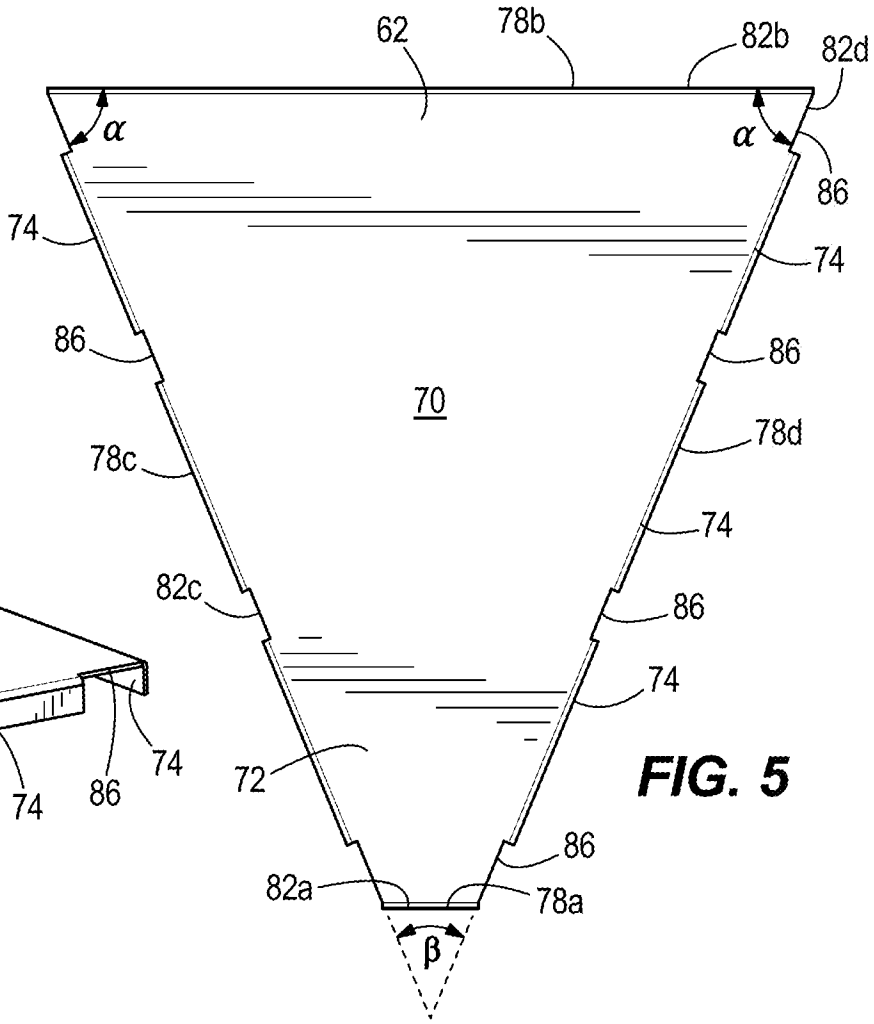
FIG. 5 is a top view of the corner shelf bridge of FIG. 4.
Figure 4:
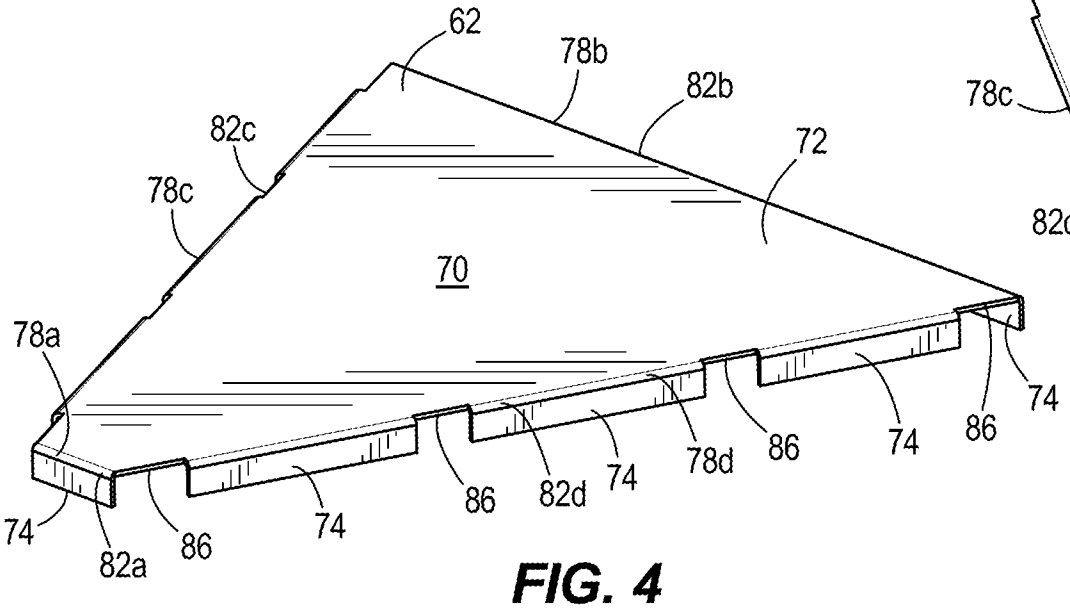
FIG. 4 is a perspective view of a corner shelf bridge of the shelving unit of FIG. 1.
Figure 6:
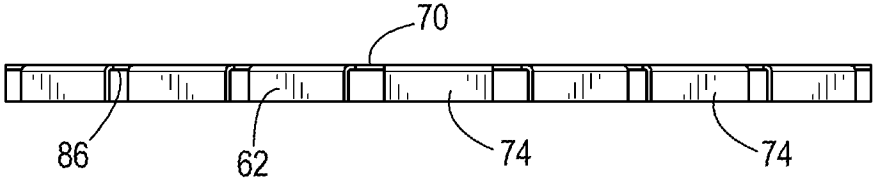
FIG. 6 is a side view of the corner shelf bridge of FIG. 4.
Figure 7:
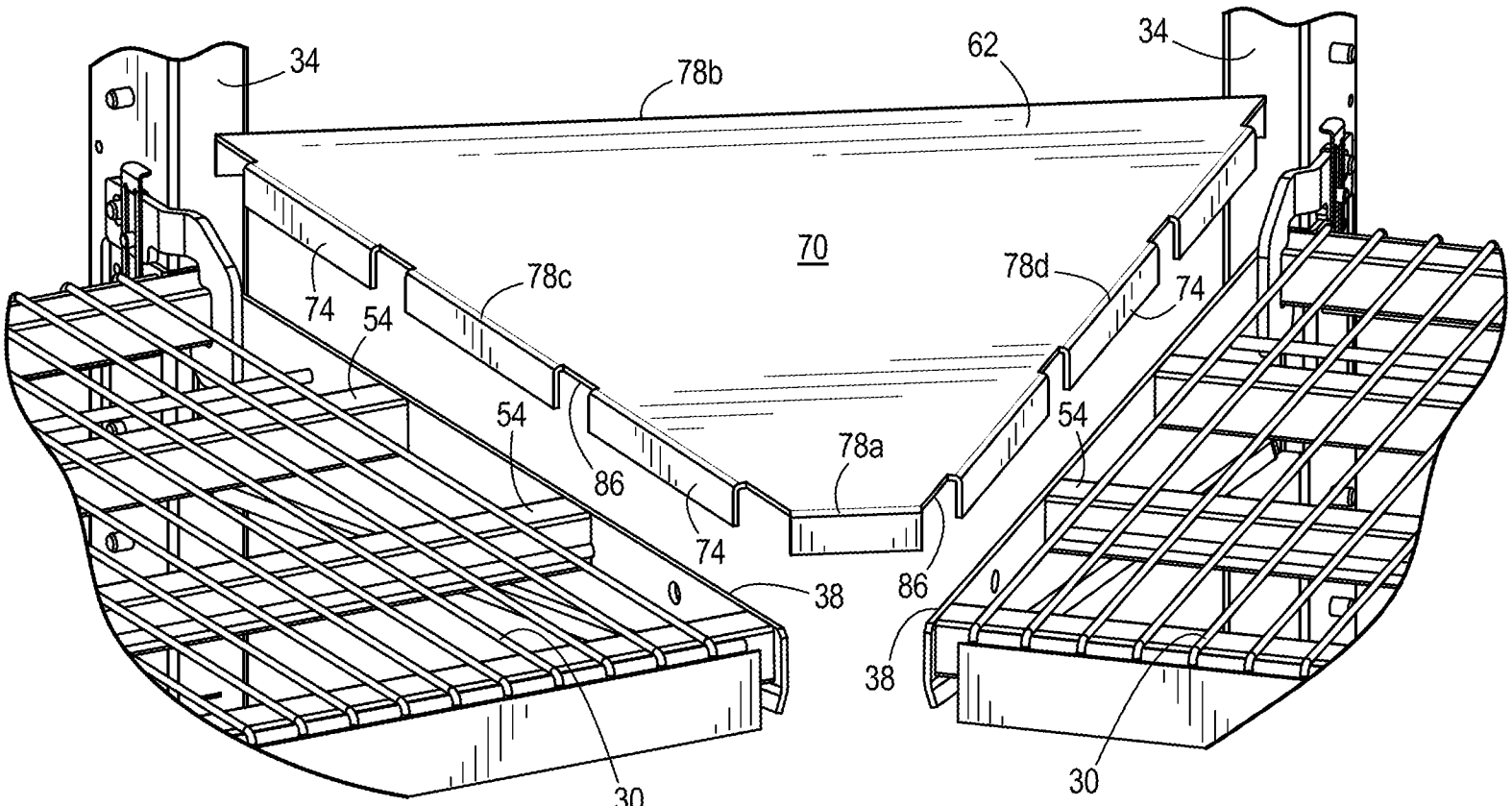
FIG. 7 is a perspective view of the corner shelf bridge of FIG. 4 positioned for engagement with two brackets.

Referring to FIGS. 4-6, in one exemplary embodiment each corner shelf bridge 62 includes a generally planar body 70 having a plurality of overhangs 74 extending therefrom. In another exemplary embodiment (not shown), the corner shelf bridges 62 can be formed from wire frames in a manner similar to shelves 30.

In the specific embodiment illustrated in FIG. 4, the body 70 includes four sides 78*a*, 78*b*, 78*c*, 78*d* and is generally shaped or formed as an isosceles trapezoid. With continued reference to FIG. 5, the first and second sides 78*a*, 78*b* of the body 70 are parallel to one another. The third and fourth sides 78*c*, 78*d* of the body 70 extend from the second side 78*b* preferably at an acute angle α (i.e., the base angle of the isosceles trapezoid) of 67.5 degrees such that projections of the third and fourth sides 78*c*, 78*d* intersect to form an angle β of 45 degrees. In other embodiments for different applications and environments, the angle α at which the third and fourth sides 78*c*, 78*d* of the body 70 extend from the second side 78*b* may be varied such that the angle β is between 0 and 90 degrees.

The overhangs 74 project from each of the four sides 78*a*, 78*b*, 78*c*, 78*d* of the body 70. With continued reference to FIGS. 4 and 5, the first side 78*a* and the second side 78*b* each include one overhang 74 that extends the length of the respective side. The third side 78*c* and the fourth side 78*d* each include a plurality of overhangs 74. Specifically, the third side 78*c* and the fourth side 78*d* each include three overhangs 74, but may include more or fewer than three overhangs 74. The overhangs 74 of the third side 78*c* and the fourth side 78*d* extend laterally beyond respective edges 82*c*, 82*d* and form a gap 86 between each of the overhangs 74 of the third and fourth side 78*c*, 78*d*. The overhangs 74 of the third side 78*c* and the fourth side 78*d* are configured to engage the brackets 38 (or 40) and/or support members 54 of adjacent shelves 30.

For example, as shown in FIGS. 1, 2, 7, and 8, each corner shelf bridge 62 is configured such that in an assembled state of the shelving system 10 each bridge 62 fits over and rests upon the bracket 38 (or 40) that supports an adjacent shelf 30 positioned on either side of the corner shelf bridge 62. In more detail, when the shelving system is assembled, each bracket 38 (or 40) adjacent to a corner shelf bridge 62 has a proximal side and a distal side relative to the corner shelf bridge 62. The corner shelf bridge 62 extends over each adjacent shelf bracket 38 (or 40) with the overhangs 74 positioned adjacent the distal side of the bracket 38. The gaps 86 formed between the overhangs 74 are positioned to align with shelf support members 54 (or another portion of the shelf). In the illustrated embodiment, the portion of the support members 54 of each shelf 30 adjacent one side of a corner shelf bridge 62 each fit within one of the gaps 86 formed between the overhangs 74.

Figure 8:
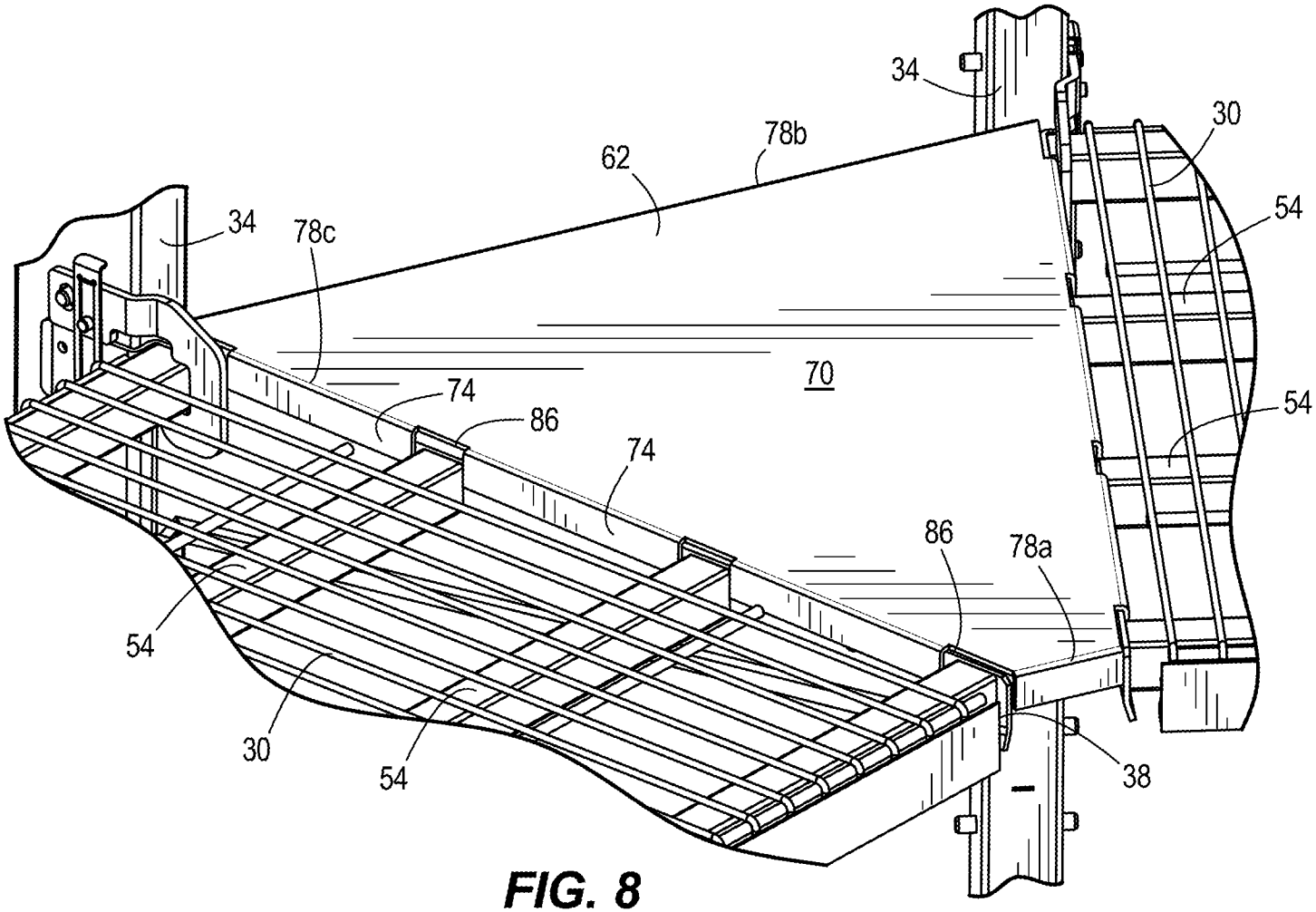
FIG. 8 is a perspective view of the corner shelf bridge of FIG. 7 in an assembled state.

Thus, when the shelving system is assembled, the corner shelf bridges 62 are placed over the shelf brackets 38 (or 40) of the adjacent shelves 30 with the overhangs 74 projecting downwardly adjacent a distal side of each adjacent bracket 38 (see FIG. 8). Shelf support members 54 (or other portions) of each adjacent shelf fit into the gaps 86 formed between the overhangs 74. Engagement of the shelves 30 with the overhangs 74 of the corner shelf bridges 62 helps to position and secure the corner bridges 62 in place on the shelf brackets 38.

Alternatively or in addition, the overhangs 74 of the third side 78*c* of a corner shelf bridge 62 may be inserted through a space between adjacent frame wires 50 of a shelf 30 of the left-hand shelving unit 14 and the overhangs 74 of the fourth side 78*d* of the corner shelf bridge 62 may be inserted through a space between adjacent frame wires 50 of a shelf 30 of the connecting shelving unit 58. Likewise, the overhangs 74 of the third side 78*c* of a corner shelf bridge 62 may be inserted through a space between adjacent frame wires 50 of the connecting shelving unit 58 and the overhangs 74 of the fourth side 78*d* of the corner shelf bridge 62 may be inserted through a space between adjacent frame wires 50 of a shelf 30 of the right-hand shelving unit 18. Accordingly, no additional fasteners are required to couple the corner shelf bridge 62 with the shelves 30.

The corner shelf bridge 62 is preferably constructed of a piece of solid sheet metal such that the body 70 is configured to provide at least part of a transition support surface 72. Therefore, a continuous supporting surface is provided between the shelf 30 of the left-hand shelving unit 14 and the shelf 30 of the right-hand shelving unit 14.

Figure 9:
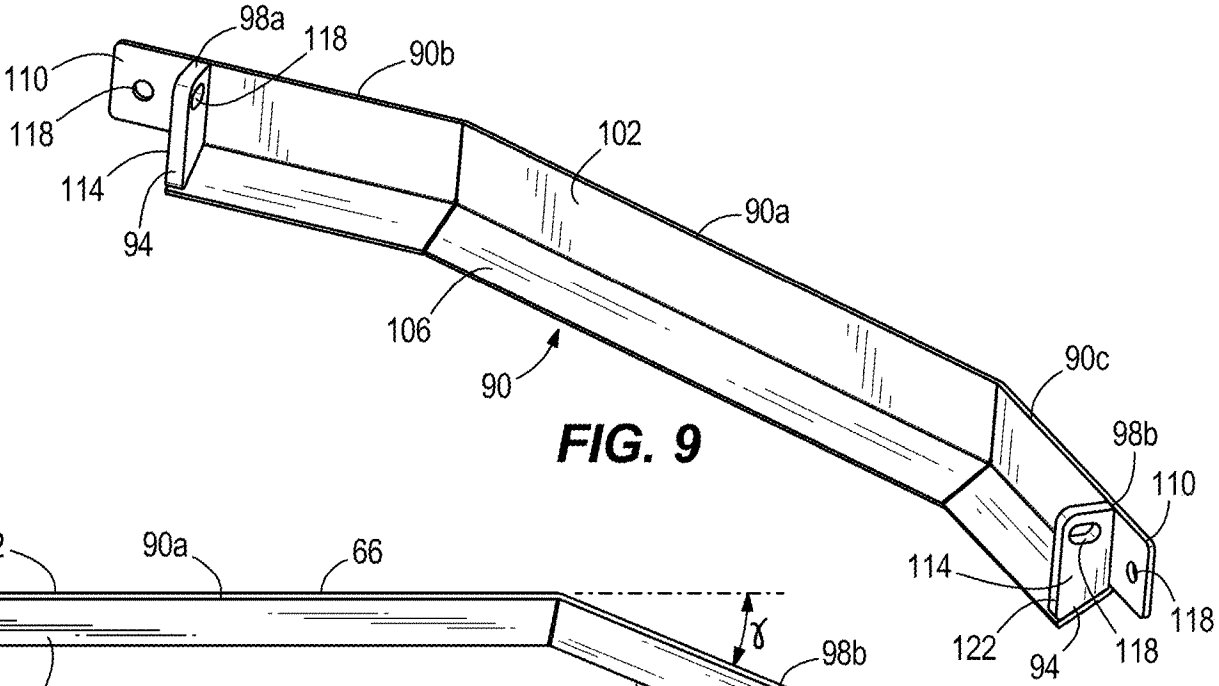
FIG. 9 is a perspective view of an angle spreader bar of the shelving unit of FIG. 1.
Figure 10:
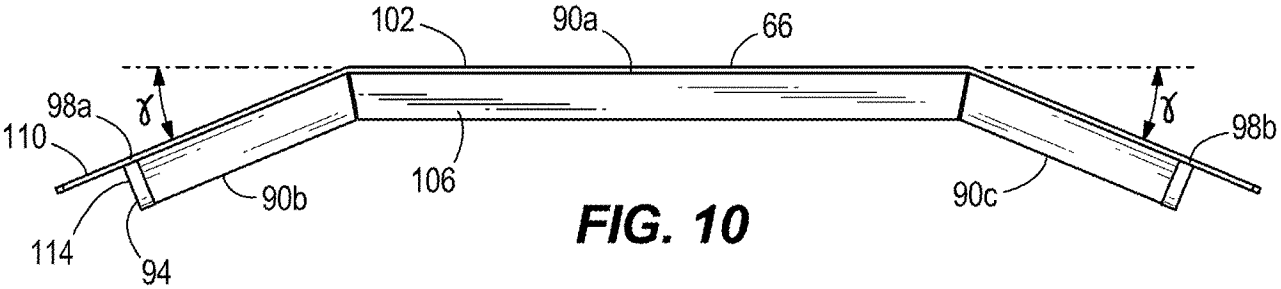
FIG. 10 is a top view of the angle spreader bar of FIG. 9.
Figure 11:
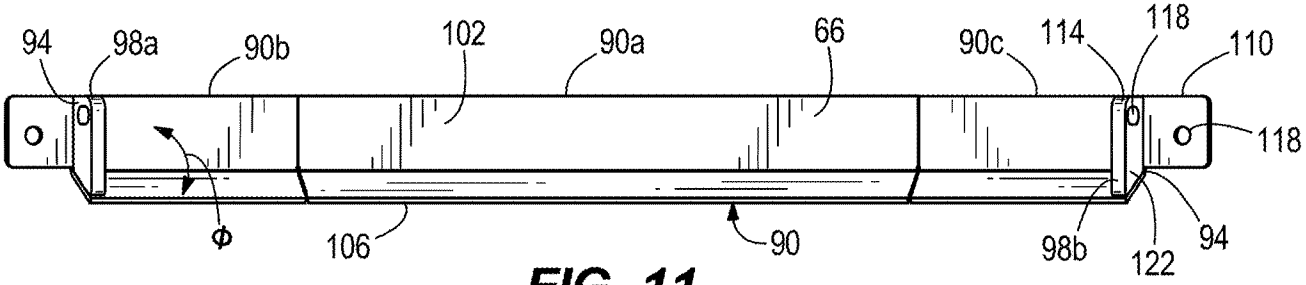
FIG. 11 is a side view of the angle spreader bar of FIG. 9.

Referring to FIGS. 9-11, the angle spreader bars or connector bars 66 each include a spacing section 90 extending between two coupling sections 94 positioned at opposite ends 98*a*, 98*b* of the angle spreader bar 66. In the embodiment illustrated in FIG. 1, the angle spreader bars 66 are attached to the vertical support posts 34 at the same height as the top support bars 42 and the crossbar 44. The spacing section 90 has a first section 90*a*, a second section 90*b*, and a third section 90*c*. The second section 90*b* and the third section 90*c* each extend from the first section 90*a* at an angle γ that is half of the angle β. Therefore, in the embodiment illustrated in FIG. 10, the angle γ is equal to 22.5 degrees. The spacing section 90 comprises a back wall 102 and a lip 106 which extends from the back wall at an angle ϕ of approximately 120 degrees, although the angle ϕ could be more or less than 120 degrees.

The coupling sections 94 are configured to attach to a respective vertical support post 34 of one of the shelving units 14, 18, 58. The coupling sections 94 each include a flange 110 that is an extension of or extends from the back wall 102 of the respective sections 90*b*, 90*c*, and a contact tab 114 which extends orthogonally from the back wall 102 and the lip 106 of the spacing section 90. The contact tab 114 presents a wall 122 configured to abut against the side of the vertical support post 34 to which the coupling section 94 is being attached. The flange 110 is configured to abut against the rear of the vertical support post 34 to which the coupling section 94 is being attached. The contact wall 122 and the flange 110 each have a hole or holes 118 so fasteners (not pictured) may be used to secure the angle spreader bar 66 to the vertical support post(s) 34. For example, the coupling section 94 at the first end 98*a* of the angle spreader bar 66 may be coupled to a vertical support post 34 of the left-hand shelving unit 14 and the coupling section 94 at the second end 98*b* of the angle spreader bar 66 may be coupled to a vertical support post 34 of the connecting shelving unit 58.

In other embodiments, the angle spreader bars 66 may be replaced as a generally straight bar having beveled ends (not illustrated). In such an embodiment, the spacing section of the straight bar is formed such that the angle γ is 0 degrees but the beveled ends of the straight bar are configured so coupling sections at each end attach to a respective vertical support post 34 of one of the shelving units 14, 18, 58 in a similar manner to the angle spreader bar 66 as described above. The coupling section 94 of such a straight bar may include a tab similar to contact tab 114 oriented at the angle γ relative to the lengthwise direction of the straight bar, but may not include a flange, like flange 110 described above, in order to make assembly between the straight bar and the shelving units 14, 18, 58 easier. In some applications, the angle spreader bars 66 may not be necessary.

Figure 3:
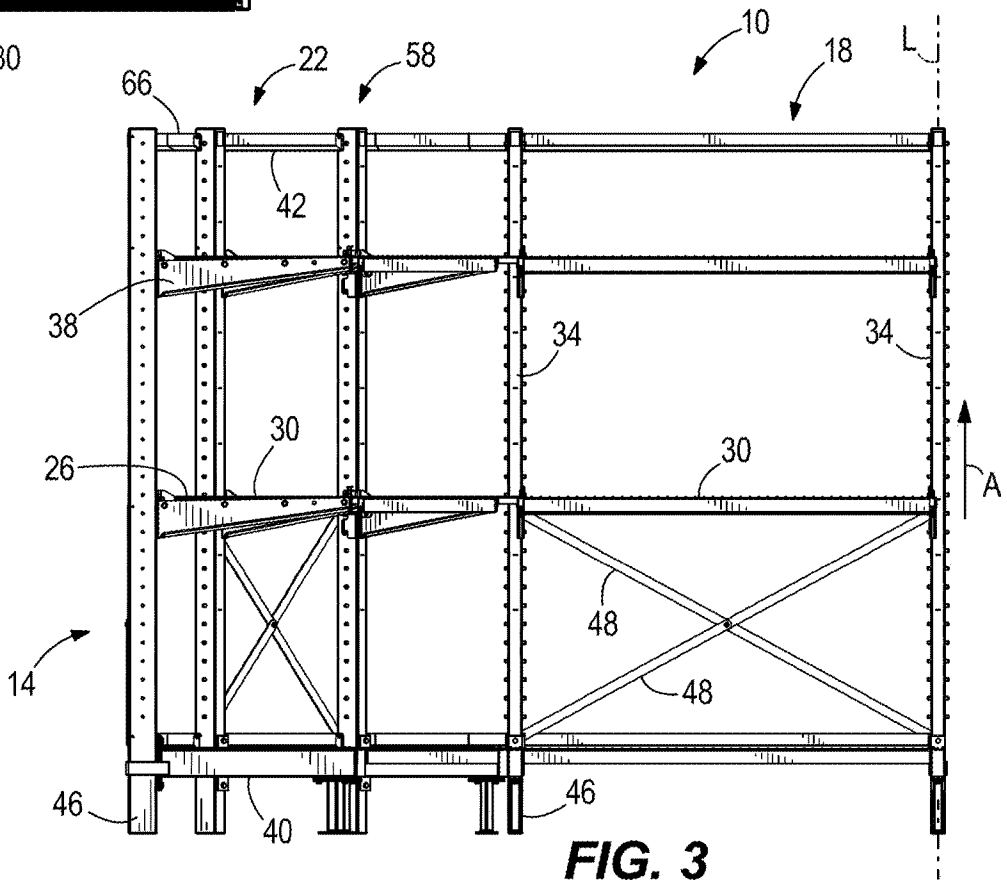
FIG. 3 is a side view of the shelving unit of FIG. 1.

As assembled, the connecting shelving unit 58, which comprises one or more shelves 30, is coupled to each of the left-hand and the right-hand shelving units 14, 18 by a set of angle spreader bars 66 and corner shelf bridges 62 (i.e., right and left sets). With reference to FIGS. 1 and 3, each set of the illustrated embodiment includes three corner shelf bridges 62 and two angle spreader bars 66. Due to the angle α being 45 degrees, two sets of corner shelf bridges 62 and angle spreader bars 66, and therefore one connecting shelving unit 58, are implemented to traverse a 90-degree corner.

Referring to FIG. 1 and to the left (from that view) of the connecting shelving unit 58, the coupling section 94 at the first end 98*a* of each angle spreader bar 66 is attached to the right vertical support post 34 of the left-hand shelving unit 14 via fasteners through the respective holes 118 of the flange 110 and the contact wall 122, and the coupling section 94 at the second end 98*b* of the angle spreader bar 66 is attached to the left vertical support post 34 of the connecting shelving unit 58 via fasteners through the respective holes 118 of the flange 110 and the contact wall 122. Still referring to FIG. 1, the overhangs 74 on the third side 78*c* of each corner shelf bridge 62 engage with the brackets 38 (or 40) and/or the support members 54 of shelves 30 of the left-hand shelving unit 14, and the overhangs 74 on the fourth side 78*d* of each corner shelf bridge 62 engage with the brackets 38 (or 40) and/or the support members 54 of shelves 30 of the connecting shelving unit 58.

Referring to FIG. 1 and to the right (from that view) of the connecting shelving unit 58, the coupling section 94 at the first end 98*a* of each angle spreader bar 66 is attached to the right vertical support post 34 of the connecting shelving unit 58 via fasteners through the respective holes 118 of the flange 110 and the contact wall 122, and the coupling section 94 at the second end 98*b* of the angle spreader bar 66 is attached to the left vertical support post 34 of the right-hand shelving unit via fasteners through the respective holes 118 of the flange 110 and the contact wall 122. Still referring to FIG. 1, the overhangs 74 on the third side 78*c* of each corner shelf bridge 62 engage with the brackets 38 (or 40) and/or the support members 54 of shelves 30 of the connecting shelving unit 58, and the overhangs 74 on the fourth side 78*d* of each corner shelf bridge 62 engage with the brackets 38 (or 40) and/or the support members 54 of shelves 30 of the right-hand shelving unit 18.

With continued reference to FIGS. 1-3, the two sets of corner shelf bridges 62 and angle spreader bars 66 and the connecting shelving unit 58 of the shelf corner unit 22 provide a smooth transition across the 90-degree corner. The shelf corner unit 22 facilitates a continuous supporting surface (26, 72) that spans an arc of 90 degrees from the left-hand shelving unit 14 to the right-hand shelving unit 18. In the illustrated embodiment, a plane coextensive with the support surface 26 is coplanar or aligned with a plane coextensive with the transition surface 72 in the assembled state. In other embodiments, a small drop or rise from the plane of the support surface 26 to the plane of the transition surface 72 may be present in the assembled state.

As briefly mentioned above, the shelf corner unit 22 may be adapted to provide a smooth transition across corners that are not 90 degrees by appropriately modifying the angles α, β, and γ.

Furthermore, the illustrated embodiment of FIGS. 1-2 shows a shelf corner unit 22 having two sets of angle spreader bars 66 and corner shelving bridges 62, each set separated by one connecting shelving unit 58. In other embodiments, varying numbers of sets of angle spreader bars 66 and corner shelving bridges 62 and connecting shelving units 58 may be provided. The number of sets of angle spreader bars 66 and corner shelving bridges 62 is generally one greater than the number of connecting shelving units 58. In some embodiments, the angle β may be 90 degrees so that only one set of angle spreader bars 66 and corner shelving bridges 62 is necessary to transition across a 90-degree corner (with appropriate modifications to the spreader bars 66, e.g., the angle γ), and the connecting shelving unit 58 may in such a case be omitted. In other embodiments, the angle β may be 30 degrees so that three sets of angle spreader bars 66 and corner shelving bridges 62 and two connecting shelving units 58 (sized accordingly) provide an even more gradual transition across a 90-degree corner.

Thus, the disclosure provides, among other things, a shelf corner unit for a shelving system. While the above describes example embodiments of the present disclosure, these descriptions should not be viewed in a limiting sense. Rather, several variations and modifications may be made without departing from the scope of the present disclosure.

The invention claimed is:

1. A shelf assembly comprising:

a first shelf unit including a first shelf, a first vertical support post, a second vertical support post, a first bracket configured to couple the first shelf to the first vertical support post, and a second bracket configured to couple the first shelf to the second vertical support post, wherein the first shelf is configured such that in an assembled state of the shelving system the first shelf extends between the first vertical support post and the second vertical support post and presents a first support surface configured to support a number of objects;

a second shelf unit including a second shelf, a third vertical support post, a fourth vertical support post, a third bracket configured to couple the second shelf to the third vertical support post, and a fourth bracket configured to couple the second shelf to the fourth vertical support post, wherein the second shelf is configured such that in an assembled state of the shelving system the second shelf extends between the third vertical support post and the fourth vertical support post and presents a second support surface configured to support a number of objects;

a third shelf unit including a third shelf, a fifth vertical support post, a sixth vertical support post, a fifth bracket configured to couple the third shelf to the fifth vertical support post, and a sixth bracket configured to couple the third shelf to the sixth vertical support post, wherein the third shelf is configured such that in an assembled state of the shelving system the third shelf extends between the fifth vertical support post and the sixth vertical support post and presents a third support surface configured to support a number of objects;

a first bridge having a support surface, wherein the first bridge is configured such that in an assembled state of the shelving system the first bridge provides a support surface between the first shelf and the third shelf, wherein the first bridge is removably coupleable to the first shelf unit and the third shelf unit; and a second bridge having a support surface, wherein the second bridge is configured such that in an assembled state of the shelving system the second bridge provides a support surface between the second shelf and the third shelf, wherein the second bridge is removably coupleable to the second shelf unit and the third shelf unit, wherein the first bridge and the second bridge are configured such that in an assembled state of the shelving system, the first shelf unit is oriented 90 degrees relative to the second shelf unit.

2. The shelf assembly according to claim 1, wherein the shelf assembly further comprises a first connector bar that extends between the second vertical support post and the fifth vertical support post, and a second connector bar that extends between the third vertical support post and the sixth vertical support post.

3. The shelf assembly according to claim 1, wherein in an assembled state of the shelving system the second vertical support post is adjacent the first bridge and the third vertical support post is adjacent the second bridge, wherein the first bridge is configured such that in an assembled state of the shelving system the first bridge rests on the second bracket and the fifth bracket, and wherein the second bridge is configured such that in an assembled state of the shelving system the second bridge rests on the third bracket and the sixth bracket.

4. The shelf assembly according to claim 3, wherein the first bridge is configured such that in an assembled state of the shelving system the first bridge captures a portion of each of the second bracket and the fifth bracket, and wherein the second bridge is configured such that in an assembled state of the shelving system the second bridge captures a portion of each of the third bracket and the sixth bracket.

5. The shelf assembly according to claim 1, wherein at least one of the first shelf, second shelf, third shelf, first bridge, and second bridge are wire frames and each of the first bridge and the second bridge is configured such that in an assembled state of the shelving system the first bridge fits over a portion of the first shelf and the third shelf and the second bridge fits over a portion the second shelf and the third shelf.

6. The shelf assembly according to claim 1, wherein each of the first bridge and of the second bridge is shaped as an isosceles trapezoid.

7. The shelf assembly according to claim 1, wherein the first bridge and the second bridge are configured such that in an assembled state of the shelving system the first shelf is oriented 45 degrees relative to the third shelf and the second shelf is oriented 45 degrees relative to the third shelf.

8. A shelf assembly comprising:

a first shelf unit including a first shelf coupleable to a first vertical support post and a second vertical support post to present a first support surface;

a second shelf unit including a second shelf coupleable to a third vertical support post and a fourth vertical support post to present a second support surface;

a third shelf unit including a third shelf coupleable to a fifth vertical support post and a sixth vertical support post to present a third support surface;

a first bridge including a first support surface, wherein the first bridge is configured such that in an assembled state of the shelving system the first bridge provides a fourth support surface between the first shelf and the third shelf; and a second bridge including a second-support surface, wherein the second bridge is configured such that in an assembled state of the shelving system the second bridge provides a fifth support surface between the second shelf and the third shelf, wherein the first bridge and the second bridge are configured such that in an assembled state of the shelving system a support surface spans an arc of 90 degrees between the first shelf and the second shelf, and wherein in an assembled state of the shelving system the first, second, third, fourth, and fifth support surfaces form a contiguous support surface that extends across the first, second, and third shelf units and first and second bridges.

9. The shelf assembly according to claim 8, wherein the first bridge and the second bridge are configured such that in an assembled state of the shelving system the first shelf is oriented at a 90 degree angle relative to the second shelf and the third shelf is oriented at less than a 90 degree angle relative to each of the first shelf and the second shelf.

10. The shelf assembly according to claim 8, wherein the first bridge and the second bridge are configured such that in an assembled state of the shelving system the first bridge is oriented at less than a 90 degree angle relative to the first and third shelves, the second bridge is oriented at less than a 90 degree angle relative to the second and third shelves, the third shelf is oriented at less than a 90 degrees angle relative to the first and second shelves, and the first shelf is oriented at a 90 degree angle relative to the second shelf.

11. The shelf assembly according to claim 8, wherein at least one of the first shelf, second shelf, third shelf, first bridge, and second bridge are wire frames and each of the first bridge and the second bridge is configured such that in an assembled state of the shelving system the first bridge fits over a portion of the first shelf and the third shelf and the second bridge fits over a portion the second shelf and the third shelf.

12. A shelf assembly comprising:

a first shelf unit including a first shelf, a first vertical support post, a second vertical support post, a first bracket configured to couple the first shelf to the first vertical support post, and a second bracket configured to couple the first shelf to the second vertical support post, wherein the first shelf is configured such that in an assembled state of the shelving system the first shelf extends between the first vertical support post and the second vertical support post and presents a first support surface configured to hold and support a number of objects;

a second shelf unit including a second shelf, a third vertical support post, a fourth vertical support post, a third bracket configured to couple the second shelf to the third vertical support post, and a fourth bracket configured to couple the second shelf to the fourth vertical support post, wherein the second shelf is configured such that in an assembled state of the shelving system the second shelf extends between the third vertical support post and the fourth vertical support post and presents a second support surface configured to support a number of objects;

a third shelf unit including a third shelf, a fifth vertical support post, a sixth vertical support post, a fifth bracket configured to couple the third shelf to the fifth vertical support post, and a sixth bracket configured to couple the third shelf to the sixth vertical support post, wherein the third shelf is configured such that in an assembled state of the shelving system the third shelf extends between the fifth vertical support post and the sixth vertical support post and presents a third support surface configured to support a number of objects;

a first bridge configured to support a number of objects, wherein the first bridge is configured such that in an assembled state of the shelving system the first bridge provides a support surface between the first shelf and the third shelf, wherein the perimeter of the first bridge is formed from four sides with first and second opposed sides parallel to one another and third and fourth opposed nonparallel sides extending between the first and second opposed sides, wherein at least one overhang projects from each of the four sides and each of the at least one overhang that projects from the third and fourth nonparallel sides is configured such that in an assembled state of the shelving system each of the at least one overhang that projects from the third and fourth nonparallel sides is positioned adjacent to one of the second bracket and the fifth bracket to removably couple the first bridge to the first shelf unit and the third shelf unit; and a second bridge configured to support a number of objects, wherein the second bridge is configured such that in an assembled state of the shelving system the second bridge provides a support surface between the second shelf and the third shelf, wherein the perimeter of the second bridge is formed from four sides with first and second opposed sides parallel to one another and third and fourth opposed nonparallel sides extending between the first and second opposed sides, wherein at least one overhang projects from each of the four sides and each overhang that projects from the third and fourth nonparallel sides is configured such that in an assembled state of the shelving system each overhang that projects from the third and fourth nonparallel sides is positioned adjacent to one of the third bracket and the sixth bracket to removably couple the second bridge to the second shelf unit and the third shelf unit, wherein the first bridge and the second bridge are configured such that in an assembled state of the shelving system, the first shelf unit is oriented 90 degrees relative to the second shelf unit.

13. The shelving system of claim 12, wherein the at least one overhang that projects from each of the third and fourth nonparallel sides of the first bridge and the second bridge is a first overhang and further comprising a second overhang that projects from each of the third and fourth nonparallel sides of the first bridge and the second bridge, wherein there is a gap between the first overhang and the second overhang that projects from each of the third and fourth nonparallel sides of the first bridge and the second bridge, and each gap is positioned such that in an assembled state of the shelving system each gap receives a portion of one of the first shelf, the second shelf, or the third shelf.

14. The shelving system of claim 12, wherein each of the at least one overhangs that projects from each of the third and fourth nonparallel sides is positioned such that in an assembled state of the shelving system each of the at least one overhangs that projects from each of the third and fourth nonparallel sides is received in an opening of one of the first shelf, the second shelf, or the third shelf.

15. The shelving system of claim 12, further comprising a first connector bar and a second connector bar, wherein the first connector bar is configured to removably couple to the second vertical support post and the fifth vertical support post and the second connector bar is configured to removably couple to the third vertical support and the sixth vertical support post.

16. The shelving system of claim 15, wherein each of the first connector bar and the second connector bar comprises a spacing section that extends between two coupling sections positioned at opposite ends of the connector bar, wherein the spacing section is nonlinear and each of the coupling sections is configured to removably couple the connector bar to one of the vertical support posts.

17. The shelving system of claim 16, wherein the spacing section comprises a first section, a second section, and a third section, wherein the second section and the third section extend from opposite ends of the first section at an angle less than 90 degrees relative thereto and one of the two coupling sections is attached to one of the second section and the third section of the spacing section and the other of the two coupling sections is attached to the other of the second section and the third section of the spacing section.

18. The shelving system of claim 17, wherein the spacing section comprises a back wall and a lip which extends from the back wall at approximately 120 degrees relative thereto and each of the coupling sections comprises a flange that is an extension of the back wall of the spacing section and a contact tab that extends orthogonally from the back wall and the lip, wherein each flange and each tab is configured such that in an assembled state of the shelving system the flange abuts one surface of one of the vertical support posts and the tab abuts another different surface of the same vertical support post which the flange abuts.

19. The shelf assembly according to claim 12, wherein at least one of the first shelf, second shelf, third shelf, first bridge, and second bridge are wire frames and each of the first bridge and the second bridge is configured such that in an assembled state of the shelving system the first bridge fits over a portion of the first shelf and the third shelf and the second bridge fits over a portion the second shelf and the third shelf.

20. The shelf assembly according to claim 12, wherein the support surface of at least one of the first bridge and the second bridge is formed from a planar body.

* * * * *